US006786061B2

(12) United States Patent
Asami et al.

(10) Patent No.: US 6,786,061 B2
(45) Date of Patent: Sep. 7, 2004

(54) AIR CONDITIONER

(75) Inventors: Yasutoshi Asami, Kawasaki (JP); Akihiko Nojima, Kawasaki (JP); Shinji Sugiyama, Kawasaki (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 10/615,948

(22) Filed: Jul. 10, 2003

(65) Prior Publication Data

US 2004/0007002 A1 Jan. 15, 2004

(30) Foreign Application Priority Data

Jul. 12, 2002 (JP) ..... 2002-203852

(51) Int. Cl.[7] ..... F25D 23/12
(52) U.S. Cl. ..... 62/263; 165/122; 454/233
(58) Field of Search ..... 62/262, 263; 165/122, 165/124, 151; 454/233

(56) References Cited

U.S. PATENT DOCUMENTS 5,388,426 A * 2/1995 Wada et al. ..... 62/263
5,626,517 A * 5/1997 Kil ..... 454/315
5,943,872 A * 8/1999 Sakurada et al. ..... 62/262
6,120,372 A * 9/2000 Riello ..... 454/233

* cited by examiner

*Primary Examiner*—Melvin Jones
(74) *Attorney, Agent, or Firm*—Manabu Kanesaka

(57) ABSTRACT

In an air conditioner having a vertical wind deflector in an air outlet, in order to blow almost all of a warm air flow toward a floor surface without leakage on the ceiling surface side at the heating operation time, a recess connecting with an air passage in a housing is formed at the front part of the air outlet, and a vertical wind deflector is disposed in the recess via a support frame. At the cooling operation time, the support frame and the vertical wind deflector are opened integrally, and at the heating operation time, only the vertical wind deflector is opened in a state in which the support frame is stored in the recess.

8 Claims, 11 Drawing Sheets

AIR CONDITIONER

TECHNICAL FIELD

The present invention relates to an air conditioner which is hung on a wall in a room. More particularly, it relates to a wind direction adjusting mechanism which appropriately changes over the wind direction of air blown from an air outlet at the cooling time and the heating time.

BACKGROUND ART

Cold air accumulates on the floor side, and warm air accumulates on the ceiling side. Therefore, an air conditioner should change over the wind direction of blown air at the cooling time and the heating time to provide a comfortable temperature environment in a room. For this purpose, the air conditioner is provided with wind direction adjusting means at an air outlet. One example of the prior art will be described with reference to FIGS. 8A and 8B.

An air conditioner shown in FIGS. 8A and 8B is a wall-mounted one that is intended to be mounted at a high position on a wall in a room, for example, at a position near a ceiling. This air conditioner has a base plate 1 which is fixed on the wall surface with screws or the like and a housing including an exterior panel 2 supported on the base plate 1. Although not shown definitely in FIG. 8 because it is a sectional view, the base plate 1 is provided with a pair of right and left side plates bent at a right angle from both ends of the base plate 1.

In this example of prior art, the exterior panel 2 includes an upper panel 21 which is increasingly curved downward to the front (in the direction away from the wall) and a lower panel 22 increasingly curved upward to the front, and the front ends of these panels are connected to each other.

The upper panel 21 is formed with an air inlet 210 in a grille form, and the lower panel 22 is formed with an air outlet 220. A heat exchanger 3 and an air blower 4 consisting of a cross-flow fan are arranged in an air passage connecting the air inlet 210 to the air outlet 220 in the housing.

In this example of prior art, the heat exchanger 3 includes a front-side heat exchanger 31 and a rear-side heat exchanger 32, which are connected to each other in a Λ shape, and dip plates 33 and 34 are disposed under these heat exchangers 31 and 32, respectively. The heat exchanger 3 and the air blower 4 are supported between the side plates of the base plate 1.

In the air outlet 220, there are provided a plurality of transverse wind deflectors 230 for changing the wind direction in the transverse direction and a first vertical wind deflector 231 and a second vertical wind deflector 232 for changing the wind direction in the vertical direction. The vertical wind deflectors 231 and 232 are turned around support shafts 231*a* and 232*a*, respectively, which are provided almost horizontally in the air outlet 220. The wind deflectors 230, 231 and 232 are rotatably reciprocated by a motor, not shown.

An air passage extending from the air blower 4 to the air outlet 220 is formed by the bottom surface of the drip plate 33 arranged on the front side and a back-side wind introducing surface 101 provided on the base plate side.

At the rear edge of the air outlet 220 connecting with the back-side wind introducing surface 101, a diffuser 233 for changing the opening area of air outlet is provided so as to be capable of being opened and closed. The diffuser 233 is rotatably reciprocated around a support shaft 233*a* arranged in parallel with the support shaft 231*a*, and is provided with a motor 233*b* serving as a driving source.

At the time of cooling operation, as shown in FIG. 8A, the first and second vertical wind deflectors 231 and 232 and the diffuser 233 are at a substantially horizontal position, so that a cold air flow A which has been cooled in the heat exchanger 3 and blown from the air blower 4 is blown out in the substantially horizontal direction through the air outlet 220 toward the ceiling surface side in the room.

At the time of heating operation, as shown in FIG. 8B, the first and second vertical wind deflectors 231 and 232 and the diffuser 233 are turned in the counterclockwise direction, so that a warm air flow B which has been warmed in the heat exchanger 3 and blown from the air blower 4 is blown out in the slantwise downward direction or in the substantially vertical downward direction through the air outlet 220 toward the floor surface side in the room.

Thus, the wind direction is changed at the cooling operation time and the heating operation time. Nevertheless, the prior art suffers from a problem as described below at the time of heating operation.

At the time of heating operation, the first and second vertical wind deflectors 231 and 232 are opened as shown in FIG. 8B, but a gap is formed between the bottom surface of the drip plate 33 forming the air passage and the second vertical wind deflector 232. Therefore, some of the warm air flow B passes through this gap and leaks to the ceiling surface side as indicated by arrow mark B', so that the heating efficiency decreases accordingly.

SUMMARY OF THE INVENTION

Thereupon, an object of the present invention is to blow almost all of a warm air flow toward a floor surface without leakage on the ceiling surface side at the heating operation time in an air conditioner having a vertical wind deflector in an air outlet.

To solve the above problem, the present invention provides an air conditioner having a housing including a base plate fixed to a wall in a room and an exterior panel supported on the base plate, the exterior panel being provided with an air inlet on the upper surface side thereof and an air outlet on the lower surface side thereof, and the housing containing a heat exchanger and an air blower in an air passage connecting the air inlet to the air outlet, in which on the front side of the air outlet, a recess with a predetermined depth, which is depressed toward the inside of the housing, is formed so as to connect with the air passage, and in the recess, a vertical wind deflector which turns in the up-and-down direction around a horizontal rotating shaft and a support frame which supports the vertical wind deflector are arranged; the support frame has a rotating shaft on the rear edge side close to the air passage, and is pivotally supported by a side plate of the recess via the rotating shaft, and a front edge of the support frame is urged toward the recess by a first spring; in a state in which the vertical wind deflector is arranged on the lower surface side of the support frame, the front edge thereof is rotatably supported on the front edge side of the support frame via predetermined pivotally supporting means, and a rear edge of the vertical wind deflector is urged toward the lower surface side of the support frame by a second spring; the support frame is provided with driving force transmitting means including an input shaft, which is connected to a motor mounted on the side plate side of the recess and is rotatably inserted in the rotating shaft, and an output shaft, which is connected to the input shaft via predetermined mechanical connecting means and gives a rotation driving force of the motor to the vertical wind deflector; at the cooling operation time, the motor is rotated in the direction against the urging force of the first spring to open the front edge sides of the support frame and the vertical wind deflector integrally; and at the heating operation time, the motor is rotated in the direction against the urging force of the second spring to open only the front edge side of the vertical wind deflector.

Also, the present invention embraces a mode, as another feature, such that a diffuser is provided at a rear edge of the air outlet so as to be capable of being opened and closed, and the diffuser is provided with a transverse wind deflector.

Further, the present invention embraces a mode such that the vertical wind deflector is a second vertical wind deflector, and a first vertical wind deflector is disposed on the rear edge side in the air outlet so as to be adjacent to the second vertical wind deflector. In this case, the longitudinal width of the second vertical wind deflector is preferably larger than the longitudinal width of the first vertical wind deflector.

Also, another feature of the present invention is that the upper end surface of the recess is formed into an arcuate shape along the turning path of the front edge side of the vertical wind deflector.

In the present invention, as the mechanical connecting means connecting to the input shaft and the output shaft, an odd number of intermediate gears or a connection belt is preferably used.

Also, the present invention embraces a mode such that the driving force transmitting means is housed in a gear box consisting of a box body in which a side face formed integrally with the support frame is open and a lid body installed detachably to the opening of the box body.

From the viewpoint of design, it is preferable that in the operation stop state, the vertical wind deflector be included in a part of outside shape of the housing so as to hide the recess.

DETAILED DESCRIPTION

Figure 1A:
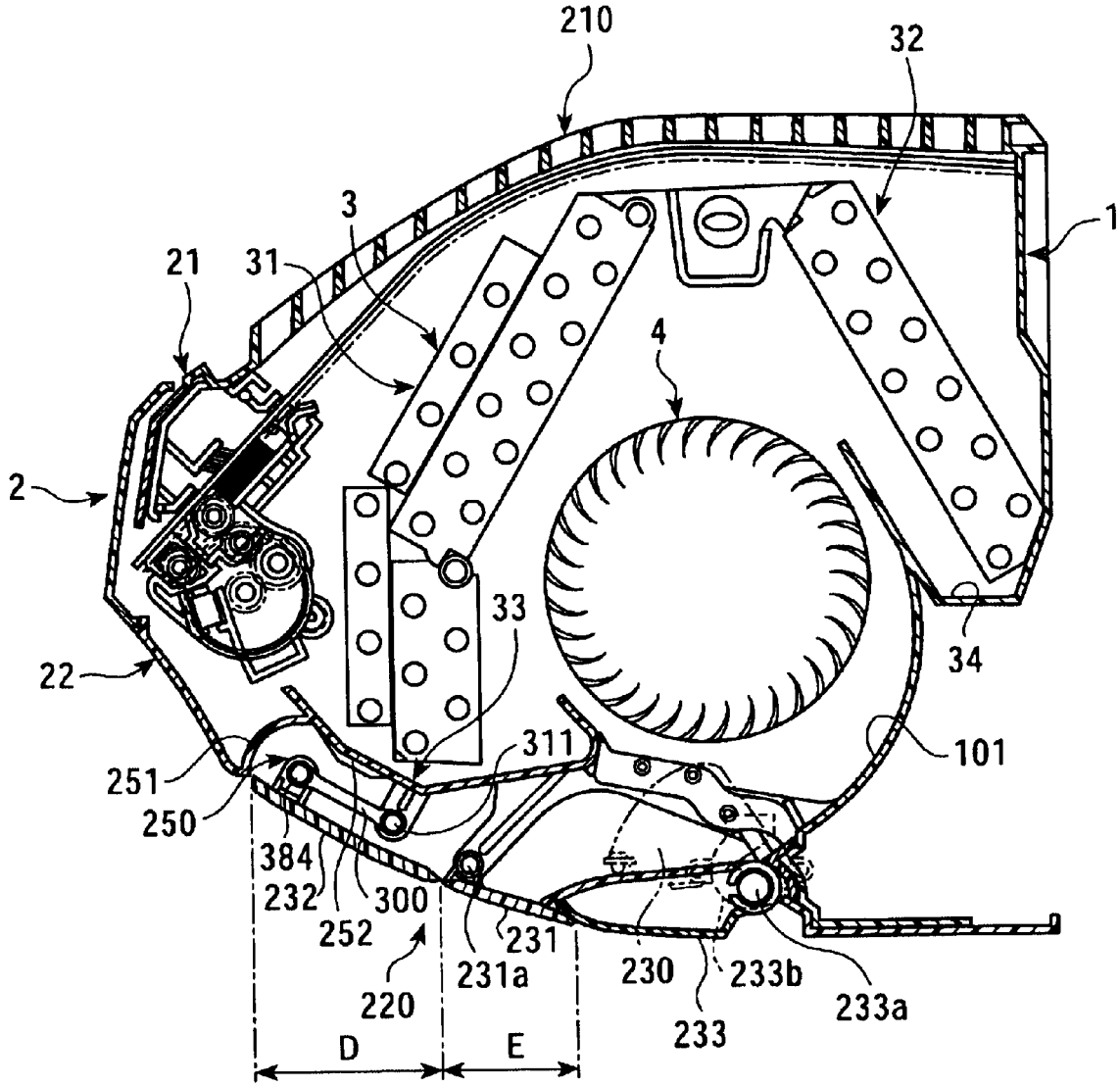
FIG. 1A is a sectional view showing a state in which the operation of an air conditioner in accordance with the present invention is stopped.

An embodiment of the present invention will now be described with reference to FIGS. 1 to 7. The present invention is not limited to the embodiment described below. In these figures, the same reference numerals are applied to elements that are the same or can be regarded as the same as the elements of the prior art described with reference to FIG. 8 before.

First, the construction of a housing can be the same as that of the prior art described before. Specifically, in the present invention as well, the housing has a base plate 1 and an exterior panel 2, and the exterior panel 2 includes an upper panel 21 and a lower panel 22.

The upper panel 21 is formed with an air inlet 210, and the lower panel 22 is provided with an air outlet 220.

In an air passage connecting the air inlet 210 to the air outlet 220 in the housing, a heat exchanger 3 and an air blower 4 are arranged. The heat exchanger 3 includes a front-side heat exchanger 31 and a rear-side heat exchanger 32, and drip plates 33 and 34 are disposed under these heat exchangers 31 and 32, respectively.

An air passage extending from the air blower 4 to the air outlet 220 is formed by the bottom surface of the drip plate 33 arranged on the front side and a back-side wind introducing surface 101 provided on the base plate 1 side.

At the rear edge of the air outlet 220 connecting with the back-side wind introducing surface 101, a diffuser 233 for changing the opening area of air outlet is provided so as to be capable of being opened and closed. The diffuser 233 is rotatably reciprocated around a support shaft 233*a* arranged in parallel with a support shaft 231*a*, and is provided with a motor 233*b* serving as a driving source.

Figure 3A:
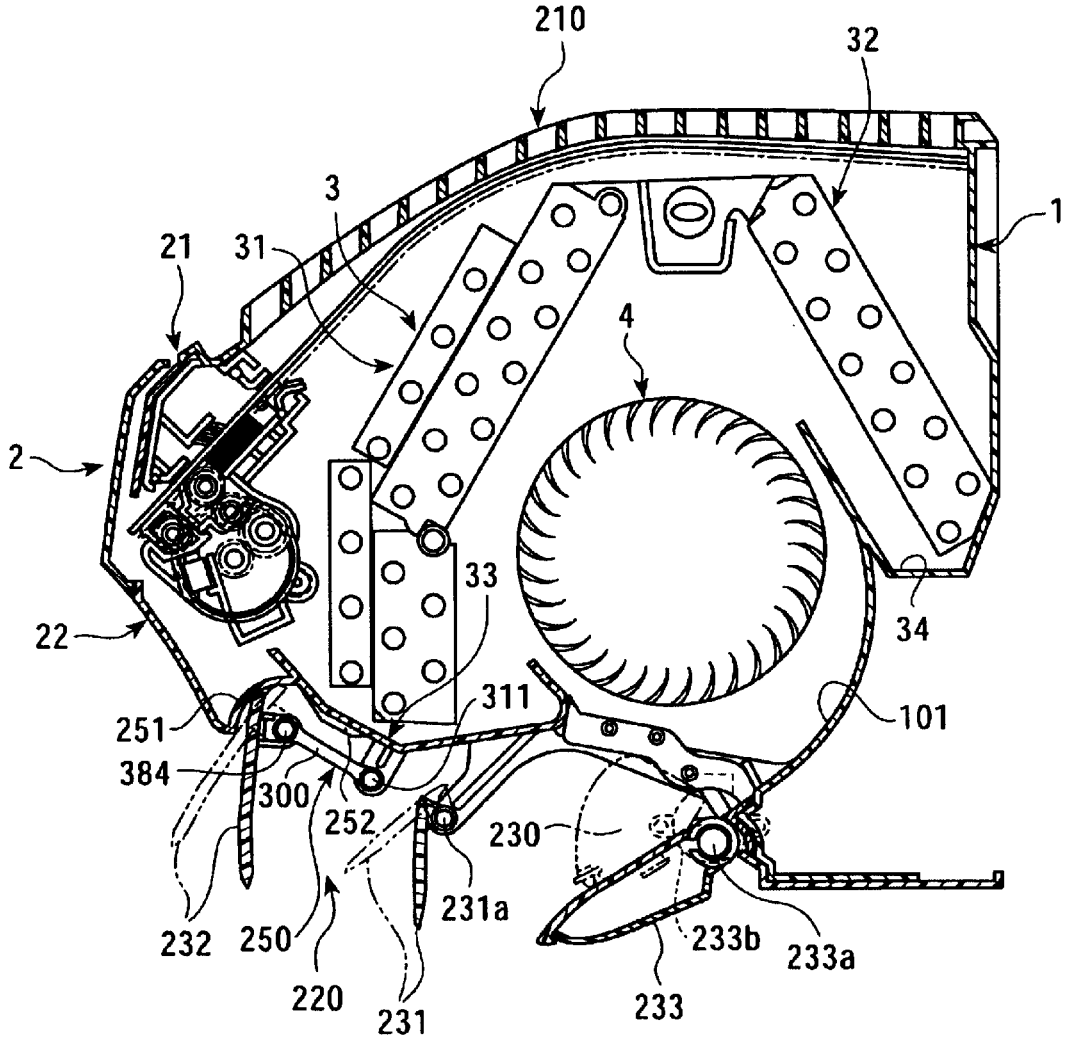
FIG. 3A is a sectional view showing a state in which an air conditioner in accordance with the present invention performs heating operation.

In the present invention, the diffuser 233 is provided with a plurality of transverse wind deflectors 230. According to this configuration, even if the diffuser 233 is turned in the counterclockwise direction and is opened as shown in FIG. 3A, for example, at the heating operation time, an air flow can effectively be directed transversely by the transverse wind deflectors 230. The directions of the transverse wind deflectors 230 may be changed manually, but it is preferable that the transverse wind deflectors 230 be driven reciproatively in a predetermined angle range by a motor, not shown.

In this example as well, in the air outlet 220, a first vertical wind deflector 231 and a second vertical wind deflector 232 are provided so as to be turnable. The arrangement sequence is such that when viewed from the exterior panel side, the second vertical wind deflector 232 lies on the front side, and the first vertical wind deflector 231 lies on the rear side.

As in the case of the prior art described before, the first vertical wind deflector 231 may be configured so as to be capable of being turned around a support shaft 231*a* provided almost horizontally in the air outlet 220.

In the present invention, the second vertical wind deflector 232 is installed in the air outlet 220 via a support frame 300, and in the air outlet 220, a recess 250 is provided to store the second vertical wind deflector 232 and the support frame 300.

The recess 250 is formed by depressing a part of the front side of the air outlet 220 toward the inside of housing, and communicates with the aforementioned air passage.

Specifically, the recess 250 is included in a part of the air outlet 220, and the blowing area of the air outlet 220 is widened by the recess 250. This configuration provides a design that visually gives an impression of a high-performance air conditioner in which a large amount of air is blown out through a large air outlet. In this example, an upper end surface 251 of the recess 250 is formed by a part of the drip plate 33, and an upper end surface 252 thereof is formed by a part of the lower panel 22.

Referring to FIGS. 4 and 5, the support frame 300 is formed of a plate material having almost the same size as that of the second vertical wind deflector 232. At one end in the transverse direction of the support frame 300 is provided a gear box 310, and at the other end thereof is provided an end plate 320.

The gear box 310 and the end plate 320 have a rotating shaft 311 and a rotating shaft 321, respectively. The rotating shaft 311 and the rotating shaft 321 are arranged coaxially on the side of a rear edge 300*b* close to the air passage side of the support frame 300.

Figure 5A:
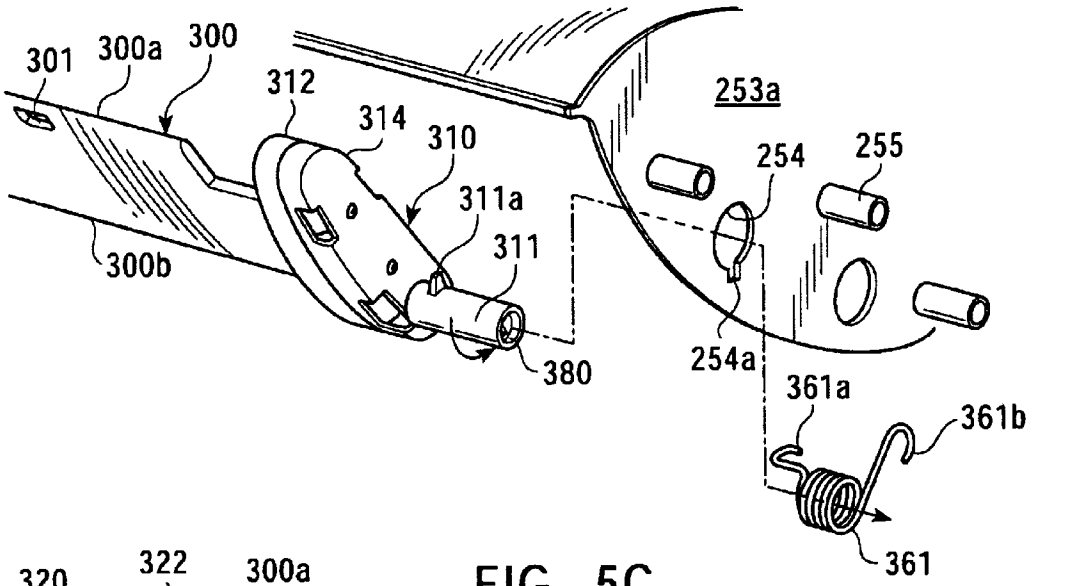
FIG. 5A is a perspective view showing a construction of one end of the support frame shown in FIG. 4A.
Figure 5C:
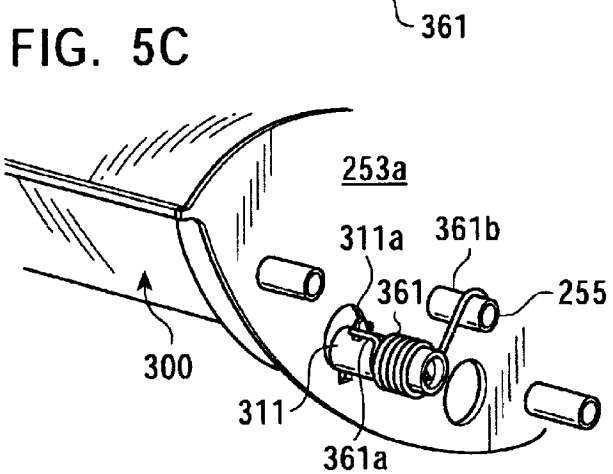
FIG. 5C is a perspective view showing a state in which the support frame is attached to a housing.
Figure 5B:
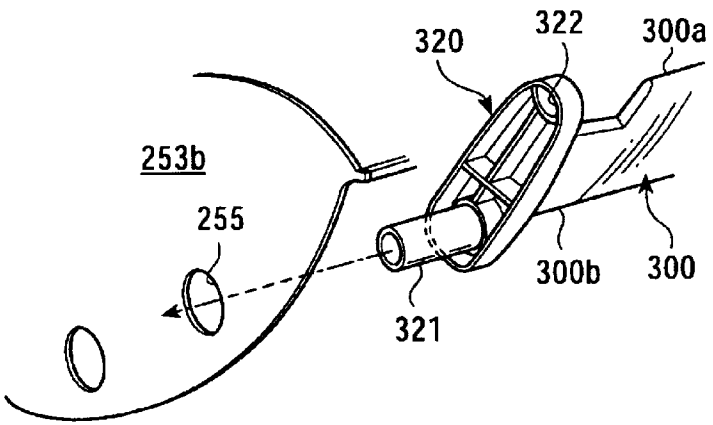
FIG. 5B is a perspective view showing a construction of the other end of the support frame.

One rotating shaft 311 is inserted in a bearing hole 254 formed in one side plate 253*a* of the recess 250 as shown in FIG. 5A, and the other rotating shaft 321 is inserted in a bearing hole 255 formed in the other side plate 253*b* of the recess 250 as shown in FIG. 5B. Each of the side plates 253*a* and 253*a* may be either the side plate of the lower panel 22 or the side plate of the base plate 1.

As shown in FIG. 5A, the rotating shaft 311 is provided with a protrusion 311*a* at a part of the outer peripheral surface, and a notch 354*a* for causing the protrusion 311*a* to pass through is formed at the edge of the bearing hole 254. After the rotating shaft 311 has been inserted into the bearing hole 254, a first spring 361 is fitted on the rotating shaft 311.

In this example, the first spring 361 consists of a coil spring having two arms 361*a* and 361*b* pulled out of the coil end. As shown in FIG. 5C, one arm 361*a* is fixed to the protrusion 311*a*, and the other arm 361*b* is fixed to a spring fixing boss 255 projectingly provided on the side wall 253*a*.

By this first spring 361, a front edge 300*a* of the support frame 300 is urged in the counterclockwise direction in FIG. 5A (the direction toward the upper end surface 251 of the recess 250).

Figure 6:
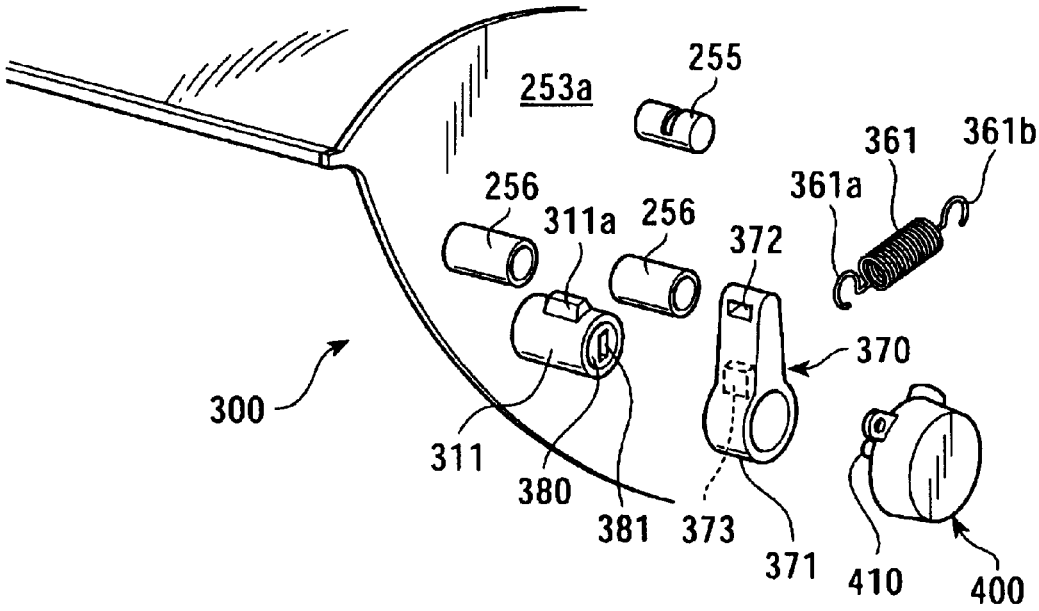
FIG. 6 is an exploded perspective view illustrating a modification of a spring member urging the support frame.

As the first spring 361, an extension spring as shown in FIG. 6 can be used. In this case, a lever 370 is used. This lever 370 is provided with a cylindrical portion 371 fitting on the rotating shaft 311 at one end thereof, and is provided with a spring fixing hole 372 at the other end thereof, and further is formed with a locking groove 373 engaging with the protrusion 311*a* on the side surface thereof.

The cylindrical portion 371 is fitted on the rotating shaft 311 while the protrusion 311*a* is engaged with the groove 373. One arm 361*a* of the first spring 361 is hooked through the hole 372, and the other arm 361*b* is hooked over the boss 255. Thereby, the support frame 300 can be urged in the counterclockwise direction as in the above-described example.

Figure 7A:
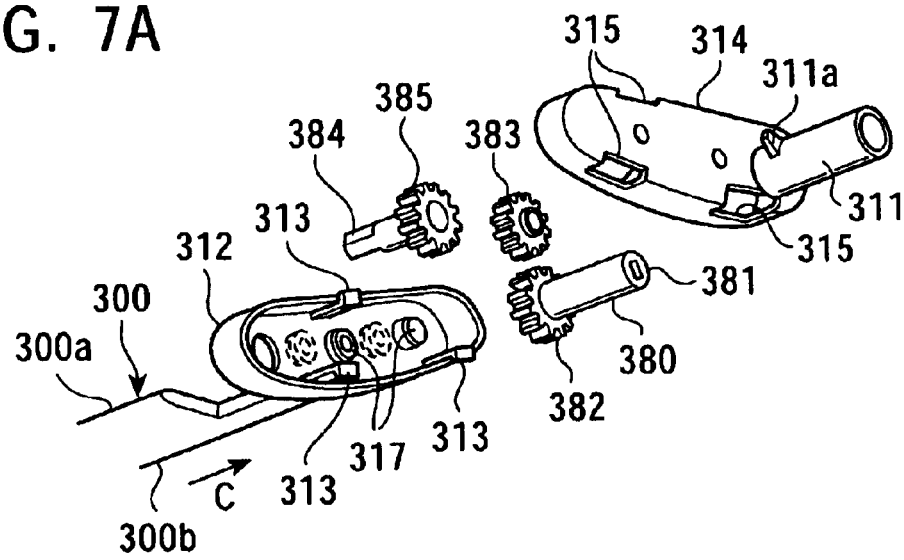
FIG. 7A is an exploded perspective view of driving force transmitting means.
Figure 7B:
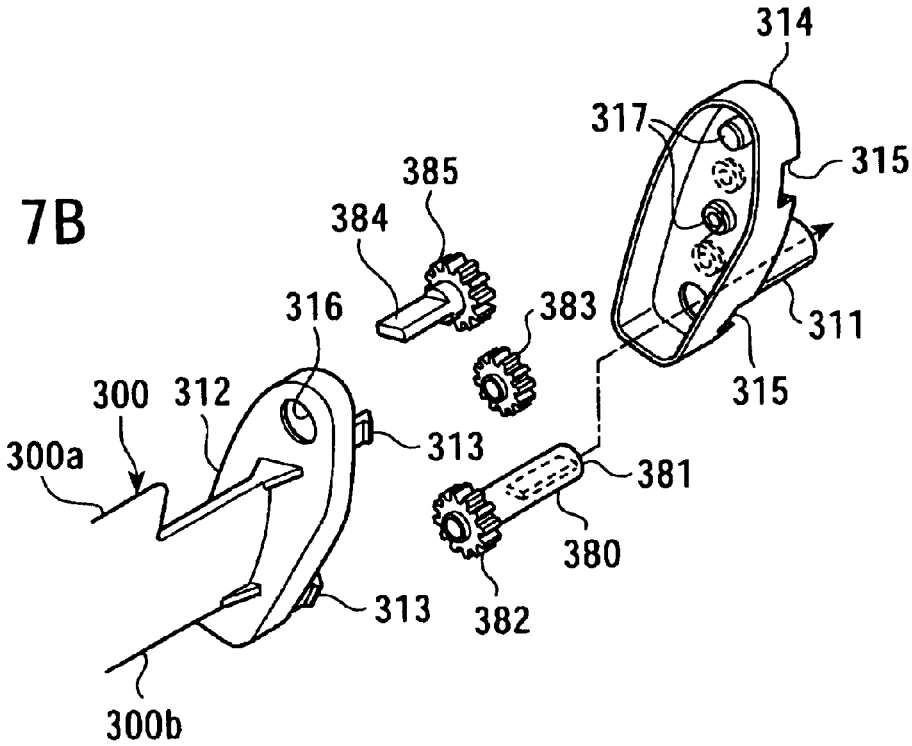
FIG. 7B is an exploded perspective view of the driving force transmitting means, viewed from the direction opposite to FIG. 7A.
Figure 8A:
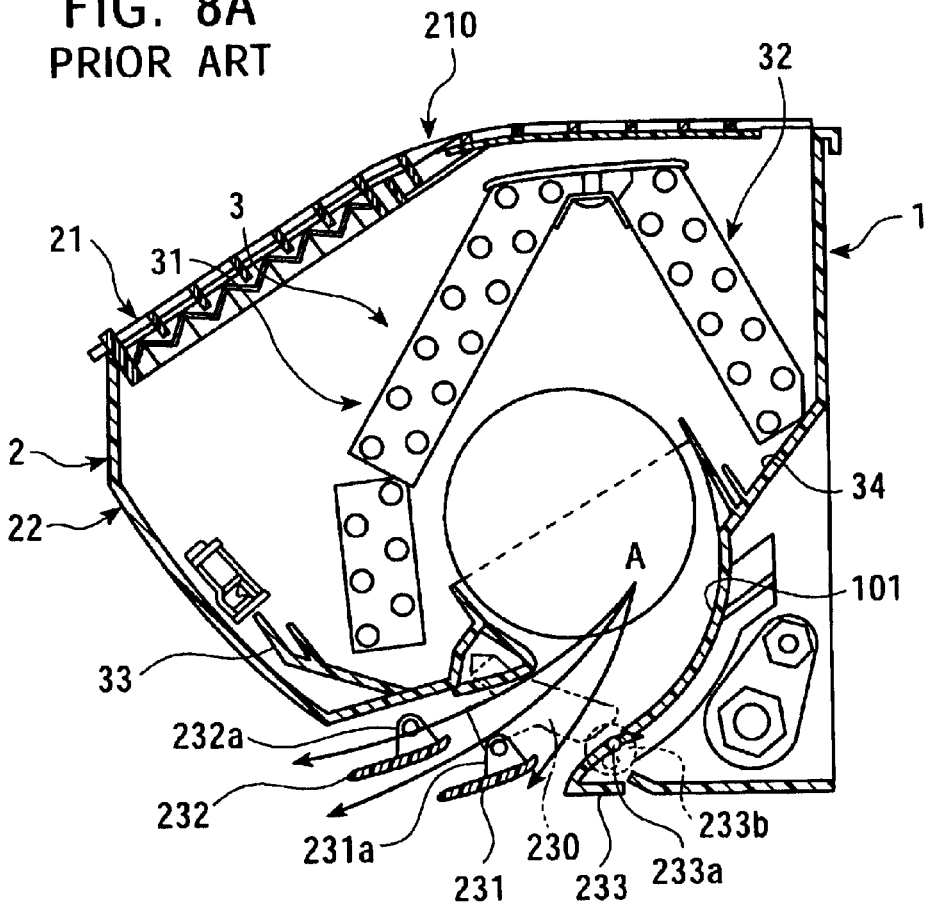
FIG. 8A PRIOR ART
FIG. 8A shows a conventional air conditioner in cooling operation.
Figure 8B:
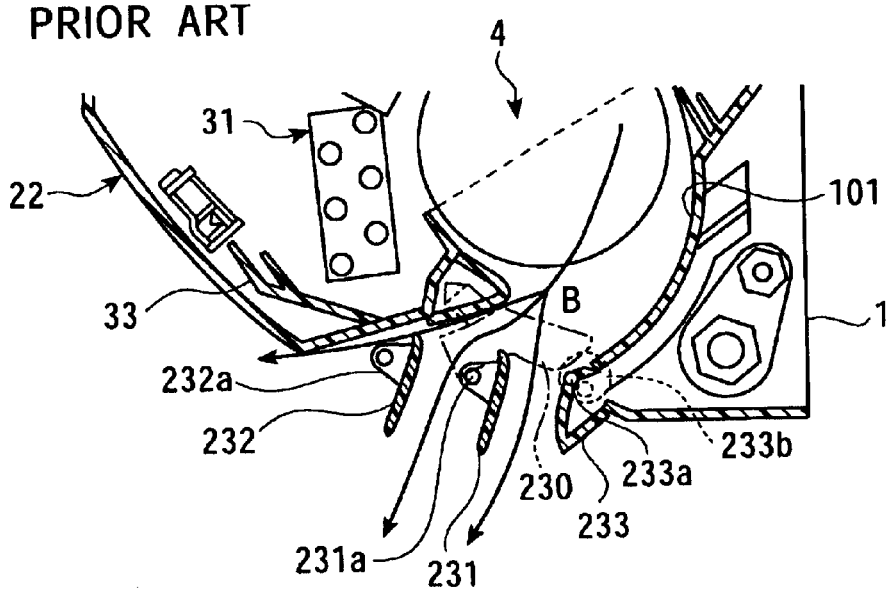
FIG. 8B PRIOR ART
FIG. 8B shows a conventional air conditioner in heating operation.

Referring to FIGS. 7A and 7B, the gear box 310 is made up of a box body 312 in which the side face formed integrally with the support frame 300 is open and a lid body 314 installed detachably to the opening of the box body 312.

In this example, both of the box body 312 and the lid body 314 have an elliptical shape. The box body 312 is provided with locking claws 313 at one place on the upper side and at two places on the lower side, and the lid body 314 is formed with engagement holes 315, which are mated with the locking claws 313, similarly at one place on the upper side and at two places on the lower side.

The gear box 310 houses an input shaft 380, an intermediate gear 383, and an output shaft 384, which constitute driving force transmitting means. The input shaft 380 is rotatably inserted in the rotating shaft 311, and at one end thereof is formed a rectangular connection hole 381 which is engaged with a driving shaft 410 of a motor 400 shown in FIG. 6. At the other end of the input shaft 380 is formed with a gear 382 meshing with the intermediate gear 383. The motor 400 is fixed with screws to the two bosses 256 erected on the side wall 253*a*.

The output shaft 384 is of a prismatic shape, and at one end thereof is provided a gear 385 meshing with the intermediate gear 383. The input shaft 380, the intermediate gear 383, and the output shaft 384 are arranged substantially on a straight line, and whereas the input shaft 380 is disposed on the rear edge 300*b* of the support frame 300, the output shaft 384 is disposed on the front edge 300*b* of the support frame 300. The output shaft 384 protrudes in parallel with the front edge 300*a* of the support frame 300 from a hole 316 formed in the box body 312.

In the gear box 310, bearing bosses 317 for the gears 382, 383 and 385 are provided. In order for the input shaft 380 and the output shaft 384 to rotate in the same direction, three intermediate gears 383 may be used although one intermediate gear 383 is used in this example. In this case, the bearing bosses 317 have only to be provided additionally at positions indicated by broken lines in the gear box 310. Also, in place of the intermediate gear, the input shaft 380 and the output shaft 384 can be connected to each other by using a belt (preferably, a timing belt).

Referring again to FIGS. 4A and 4B, the relationship between the second vertical wind deflector 232 and the support frame 300 will be explained.

Figure 4A:
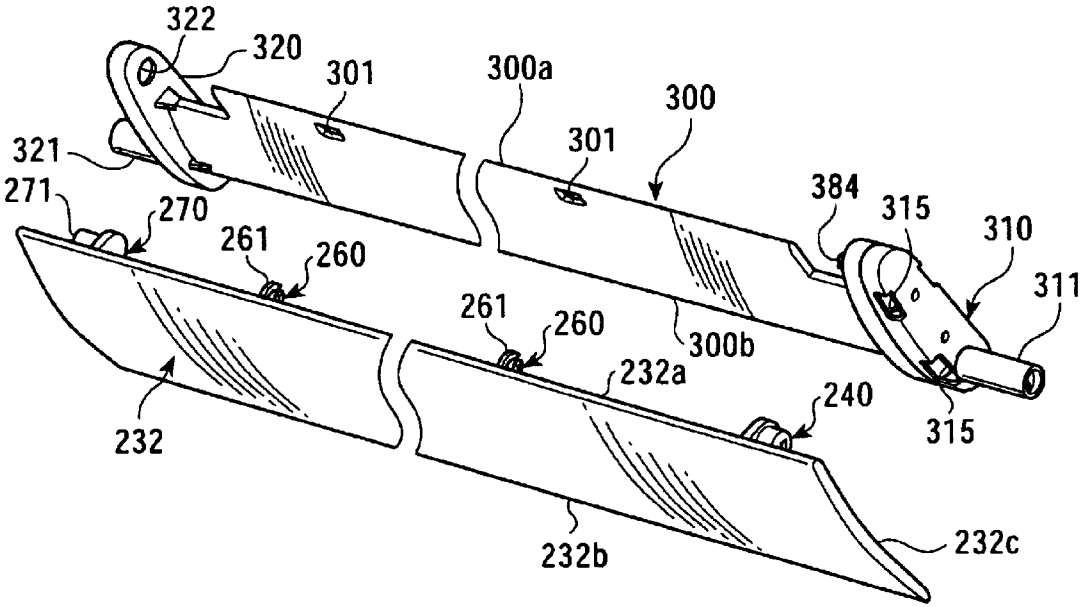
FIG. 4A is a perspective view of a support frame and a second vertical wind deflector provided in an air conditioner in accordance with the present invention, being shown separately.

In FIG. 4A, when the surface of the second vertical wind deflector 232 facing the support frame 300 is taken as a back surface, and the opposite surface thereof is taken as a top surface, on the back surface of the second vertical wind deflector 232, a first connecting portion 240 and a second connecting portion 270 are provided at transverse two places on the side of a front edge 232*a*, and between them, for example, two auxiliary connecting portions 260 are provided. These connecting portions 240, 270 and 260 are arranged on the same axis.

Figure 4B:
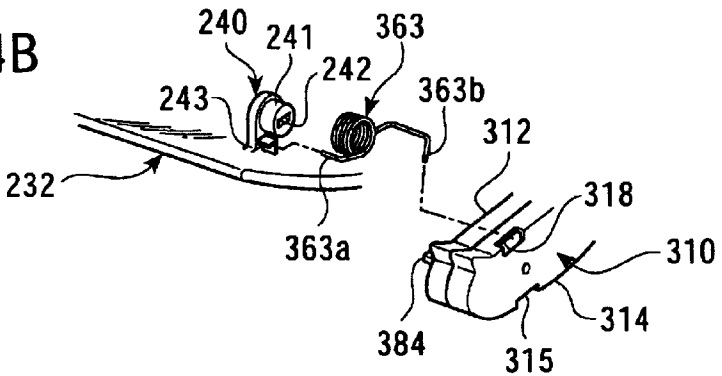
FIG. 4B is a perspective view enlargedly showing an essential portions of the support frame and the second vertical wind deflector shown in FIG. 4A.

The first connecting portion 240 is connected to the output shaft 384. As shown in FIG. 4B, the first connecting portion 240 includes a cylindrical boss 241 formed transversely in parallel with the front edge 232*a* of the second vertical wind deflector 232. This cylindrical boss 241 has a rectangular connection groove 242 in which the output shaft 384 is inserted.

Also, a second spring 363 is fitted on the cylindrical boss 241. In this example, the second spring 363 consists of a coil spring, and has two arms 363*a* and 363*b* pulled out of the coil end.

The second spring 363 is a spring for urging a rear edge 232*b* of the second vertical wind deflector 232 in the counterclockwise direction in FIG. 4A (the direction toward the upper end surface 251 of the recess 250). One arm 363*a* of the second spring 363 is hooked over a hook 243 provided on the second vertical wind deflector 232, and the other arm 363*b* thereof is hooked through an engagement hole 318 formed in the gear box 310. By this second spring 363, a side edge 232*c* of the second vertical wind deflector 232 is brought into contact with the bottom face of the gear box 310, and the bottom face serves as a stopper for determining the initial position of the second vertical wind deflector 232.

The second connecting portion 270 also includes a cylindrical boss 271 formed transversely in parallel with the front edge 232*a* of the second vertical wind deflector 232. This cylindrical boss 271 is inserted in a bearing hole 322 formed in the end plate 320 of the support frame 300.

Each of the auxiliary connecting portions 260 has a C-shaped catch portion 261 formed by cutting a part of a cylindrical portion. Corresponding to the catch portions 261, auxiliary bearing holes 301 are formed on the front edge 300*a* of the support frame 300. The catch portion 261 is rotatably installed to one side on the front edge 300*a* of the auxiliary bearing hole 301. The number of the auxiliary connecting portions 260 may be selected appropriately according to the length of the second vertical wind deflector 232.

Figure 1B:
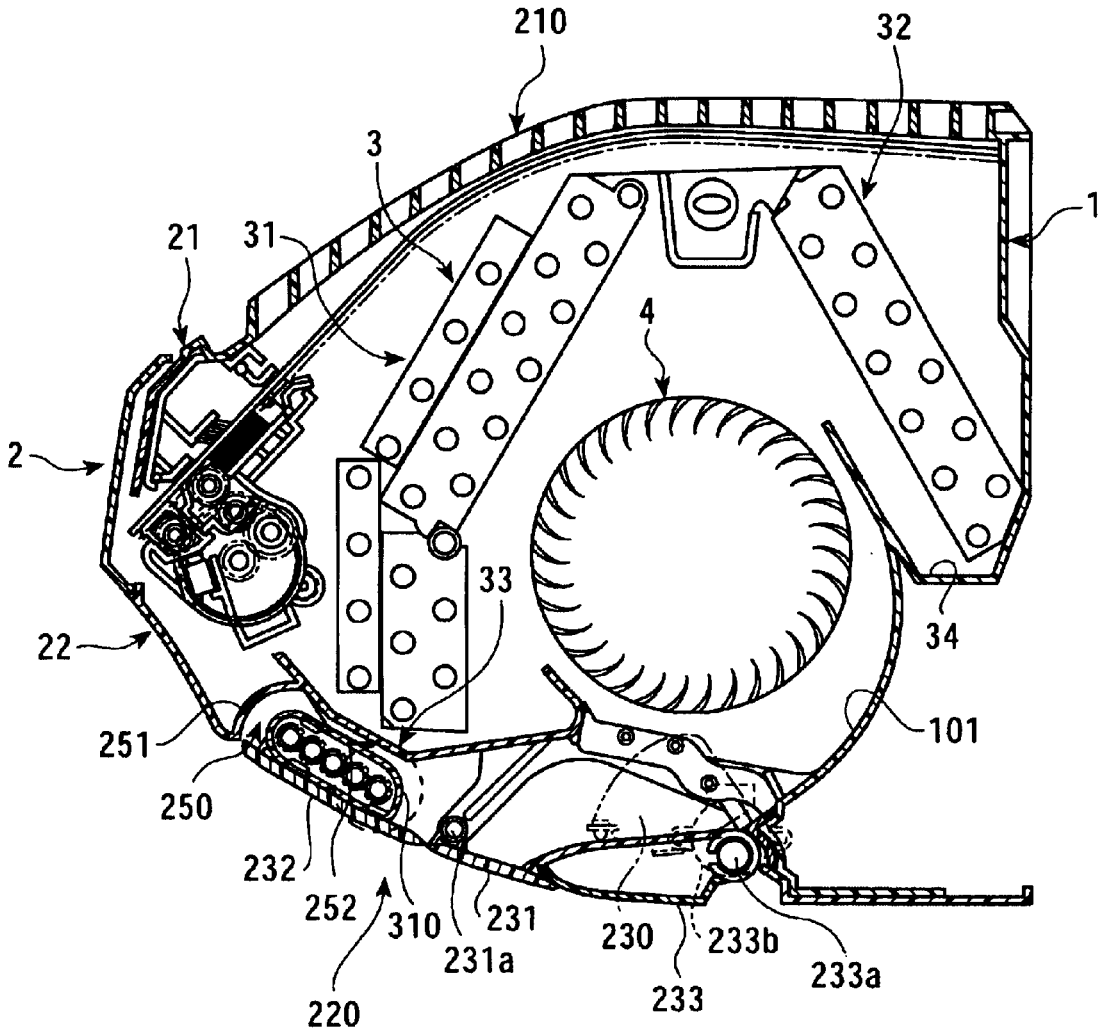
FIG. 1B is a sectional view showing the operation stop state including driving force transmitting means.

Next, the operation of the air conditioner in accordance with the present invention will be described. First, at the time of operation stop, as shown in FIGS. 1A and 1B, the air outlet 220 is closed by the first vertical wind deflector 231, the second vertical wind deflector 232, and the diffuser 233.

In this case, the support frame 300 is urged by the first spring 361 so as to be housed in the recess 250, and the second vertical wind deflector 232 is urged toward the support frame 300 by the second spring 363 to close the recess 250. Since the air outlet 220 is closed in this manner, the whole of the housing is recognized as an integrated design, and the air conditioner is hygienic because dust does not intrude into the housing through the air outlet 220.

Figure 2A:
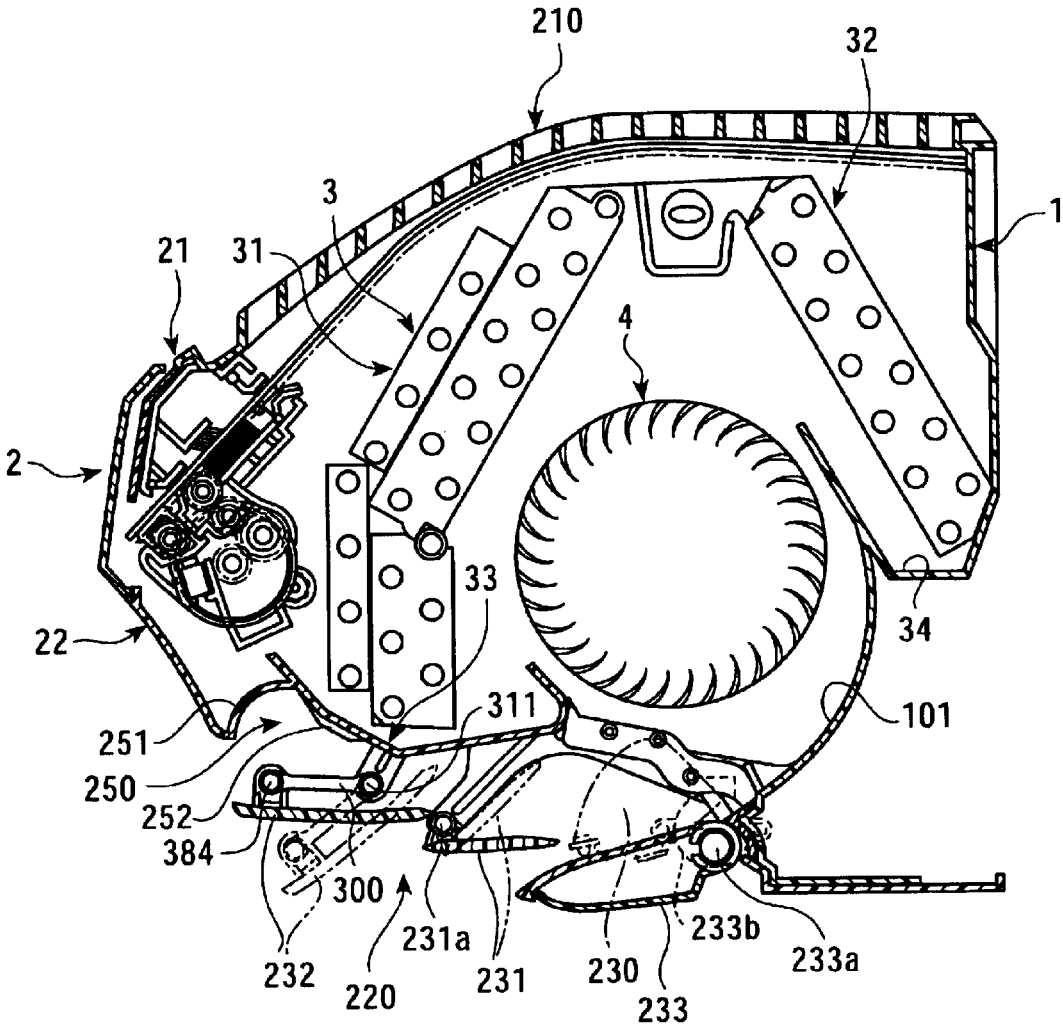
FIG. 2A is a sectional view showing a state in which an air conditioner in accordance with the present invention performs cooling operation.
Figure 2B:
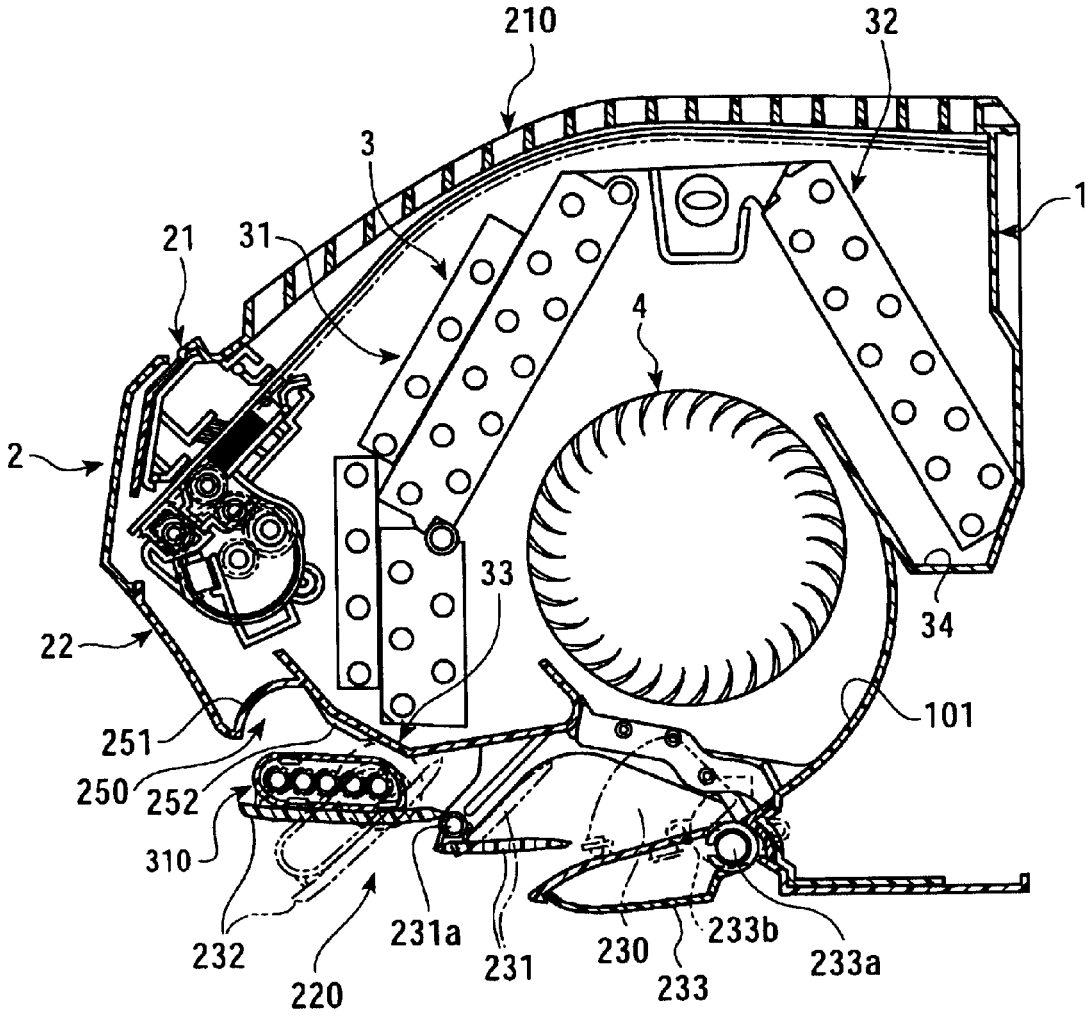
FIG. 2B is a sectional view showing the cooling operation state including driving force transmitting means.

At the cooling operation time, as shown in FIGS. 2A and 2B, the first vertical wind deflector 231 and the second vertical wind deflector 232 are turned to a substantially horizontal position. The diffuser 233 may be at the closed position.

The first vertical wind deflector 231 is driven by a special-purpose motor, not shown, and the second vertical wind deflector 232 is driven by rotating the motor 400 in the direction opposite to the urging direction of the first spring 361, that is, in the counterclockwise direction in FIG. 6.

At this time, the second vertical wind deflector 232 is brought into contact with the bottom face of the gear box 310 by the second spring 363, and the output shaft 384 is in a locked state, so that the support frame 300 is opened in the counterclockwise direction together with the second vertical wind deflector 232.

Thereby, a cold air flow which has been heat-exchanged by the heat exchanger 3 and blown by the air blower 4 is blown out in the substantially horizontal direction through the air outlet 220.

As a preferred mode of the present invention, as shown in FIG. 1A, a longitudinal width D of the second vertical wind deflector 232 is made larger than a longitudinal width E of the first vertical wind deflector 231, and the recess 250 is utilized as an air passage of the air outlet 220, by which the cold air flow can be blown to a far distance along the ceiling surface.

In the case where it is desired to direct the cold air flow slightly slantwise downward from the substantially horizontal direction, as indicated by broken lines in FIGS. 2A and 2B, the first and second vertical wind deflectors 231 and 232 have only to be further turned in the counterclockwise direction. Also, the diffuser 233 may be turned in the counterclockwise direction and be opened as necessary.

Figure 3B:
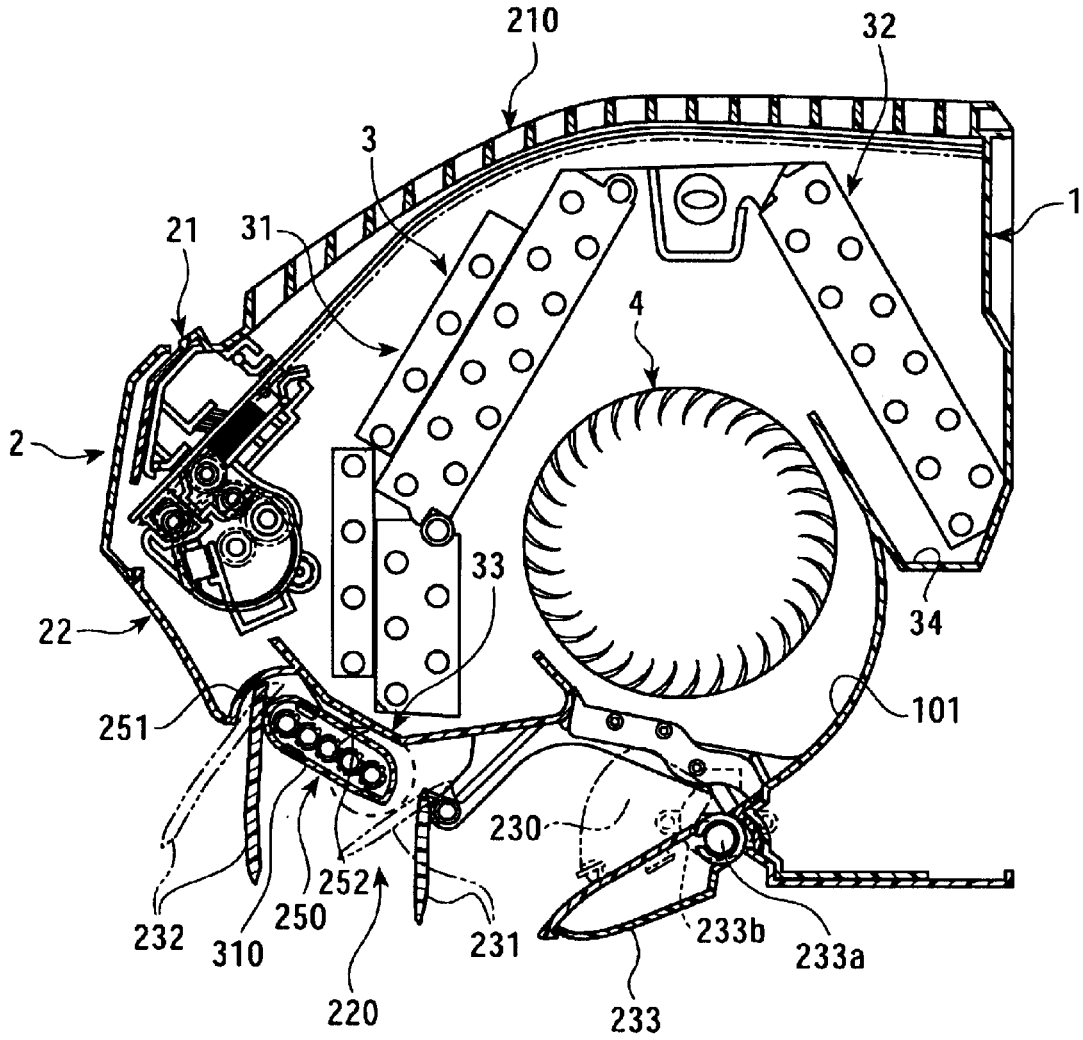
FIG. 3B is a sectional view showing the heating operation state including driving force transmitting means.

Next, at the heating operation time, as shown in FIGS. 3A and 3B, the first and second vertical wind deflectors 231 and 232 are turned so as to be substantially vertical, and the diffuser 233 is opened. To establish this state, the diffuser 233 is turned through a predetermined angle in the counterclockwise direction, and the first vertical wind deflector 231 is turned in the clockwise direction around the support shaft 231*a*.

The second vertical wind deflector 232 is turned by driving the motor 400 in the clockwise direction in FIG. 6. Specifically, the motor 400 is rotated in the direction that is the same as the urging direction of the first spring 361 but opposite to the urging direction of the second spring 363.

Thereby, the support frame 300 is held on the upper end surface 232 side of the recess 250 by the urging force of the first spring 361, but the second vertical wind deflector 232 is turned in the clockwise direction against the urging force of the second spring 363 by the output shaft 384 rotating in the clockwise direction, and the rear edge 232*b* thereof is opened.

Thereby, a warm air flow which has been heat-exchanged by the heat exchanger 3 and blown by the air blower 4 is blown out downward toward the floor surface through the air outlet 220.

In this case as well, by making the longitudinal width D of the second vertical wind deflector 232 larger than the longitudinal width E of the first vertical wind deflector 231, the warm air flow can be deflected effectively because a distance between the first vertical wind deflector 231 and the second vertical wind deflector 232 becomes large.

In the case where it is desired to blow the warm air flow slightly frontward from the substantially vertical direction at the heating operation time, as indicated by broken lines in FIGS. 3A and 3B, the first and second vertical wind deflectors 231 and 232 have only to be further turned in the clockwise direction.

Also, it is preferable that the upper end surface 251 of the recess 250 be formed into an arcuate shape along the turning path of the front edge 232*a* of the second vertical wind deflector 232.

According to this configuration, a gap between the upper end surface 251 of the recess 250 and the front edge of the second vertical wind deflector 232 can almost be eliminated regardless of the turning angle of the second vertical wind deflector 232. Therefore, the warm air flow can be deflected effectively without leakage in the horizontal direction.

The above is a detailed description of the preferred embodiment of the present invention. The present invention also embraces an air conditioner having only the second vertical wind deflector 232 as a vertical wind deflector.

What is claimed is:

1. An air conditioner having a housing including a base plate fixed to a wall in a room and an exterior panel supported on said base plate, said exterior panel being provided with an air inlet on the upper surface side thereof and an air outlet on the lower surface side thereof, and said housing containing a heat exchanger and an air blower in an air passage connecting said air inlet to said air outlet, wherein on the front side of said air outlet, a recess with a predetermined depth, which is depressed toward the inside of said housing, is formed so as to connect with said air passage, and in said recess, a vertical wind deflector which turns in the up-and-down direction around a horizontal rotating shaft and a support frame which supports said vertical wind deflector are arranged;

said support frame has a rotating shaft on the rear edge side close to said air passage, and is pivotally supported by a side plate of said recess via said rotating shaft, and a front edge of said support frame is urged toward said recess by a first spring;

in a state in which said vertical wind deflector is arranged on the lower surface side of said support frame, the front edge thereof is rotatably supported on the front edge side of said support frame via predetermined pivotally supporting means, and a rear edge of said vertical wind deflector is urged toward the lower surface side of said support frame by a second spring;

said support frame is provided with driving force transmitting means including an input shaft, which is connected to a motor mounted on the side plate side of said recess and is rotatably inserted in said rotating shaft, and an output shaft, which is connected to said input shaft via predetermined mechanical connecting means and gives a rotation driving force of said motor to said vertical wind deflector;

at the cooling operation time, said motor is rotated in the direction against the urging force of said first spring to open the front edge sides of said support frame and said vertical wind deflector integrally; and at the heating operation time, said motor is rotated in the direction against the urging force of said second spring to open only the front edge side of said vertical wind deflector.

2. The air conditioner according to claim 1, wherein at a rear edge of said air outlet connecting with a back-side wind introducing surface of said air passage, a diffuser which changes the opening area of said air outlet is provided so as to be capable of being opened and closed, and said diffuser is provided with a transverse wind deflector capable of being turned in the transverse direction, which is perpendicular to said vertical wind deflector.

3. The air conditioner according to claim 1, wherein said vertical wind deflector is a second vertical wind deflector, and a first vertical wind deflector is disposed on the rear edge side in said air outlet so as to be adjacent to said second vertical wind deflector, and also the longitudinal width of said second vertical wind deflector is larger than the longitudinal width of said first vertical wind deflector.

4. The air conditioner according to claim 1, wherein the upper end surface of said recess is formed into an arcuate shape along the turning path of the front edge side of said vertical wind deflector.

5. The air conditioner according to claim 1, wherein said mechanical connecting means connecting to said input shaft and said output shaft consists of an odd number of intermediate gears.

6. The air conditioner according to claim 1, wherein said mechanical connecting means connecting to said input shaft and said output shaft consists of a connection belt.

7. The air conditioner according to claim 1, wherein said driving force transmitting means is housed in a gear box consisting of a box body in which a side face formed integrally with said support frame is open and a lid body installed detachably to the opening of said box body.

8. The air conditioner according to claim 1, wherein in the operation stop state, said vertical wind deflector is included in a part of outside shape of said housing so as to hide said recess.

* * * * *